United States Patent [19]

Hasegawa et al.

[11] 3,955,384

[45] May 11, 1976

[54] NEEDLE SELECTION CONTROL APPARATUS FOR CIRCULAR PATTERN KNITTING MACHINES

[75] Inventors: Junzo Hasegawa, Obu; Susumu Kawabata; Yasuhiko Suzuki, both of Nagoya, all of Japan

[73] Assignees: Kabushiki Kaisha Toyota Chuo Kenkyusho, Nagoya; Kabushiki Kaisha Toyoda Jidoshokki Seisakusho, Kariya, both of Japan

[22] Filed: Mar. 5, 1975

[21] Appl. No.: 555,671

[30] Foreign Application Priority Data

Mar. 14, 1974 Japan ..... 49-29446

[52] U.S. Cl. ..... 66/154 A; 66/50 R

[51] Int. Cl.[2] ..... D04B 15/66

[58] Field of Search ..... 66/154 A, 50, 50 A, 66/50 B, 75, 56

[56] References Cited

UNITED STATES PATENTS

| | | | |
|---|---|---|---|
| 3,313,128 | 4/1967 | Schmidt et al. | 66/50 A |
| 3,313,129 | 4/1967 | Stock | 66/50 A |
| 3,561,232 | 2/1971 | Stock et al. | 66/50 R |
| 3,665,731 | 5/1972 | Groezinger | 66/50 R |
| 3,680,331 | 8/1972 | Morat | 66/154 A X |
| 3,745,791 | 7/1973 | Cuche | 66/50 R |
| 3,896,638 | 7/1975 | Gottschall | 66/50 R |

FOREIGN PATENTS OR APPLICATIONS

| | | | |
|---|---|---|---|
| 1,930,522 | 1/1970 | Germany | 66/154 A |

*Primary Examiner*—Ronald Feldbaum
*Attorney, Agent, or Firm*—Stevens, Davis, Miller & Mosher

[57] ABSTRACT

A needle selection control apparatus for circular pattern knitting machines which controls the timing of selection of a series of needles mounted on a needle cylinder. Needle synchronizing signals produced by sensor means which senses each cylinder needle rotating with said needle cylinder are electrically processed so that input pulse signals are formed whose phases have angles of lead controlled by the apparatus in accordance with the number of revolutions of the needle cylinder, and the input pulse signals are also electrically processed so as to remove unnecessary contents of the signals due to the eccentricity of the needle cylinder therefrom. The input pulse signals thus obtained are supplied to needle selector means for actuating the same at very high rotating speeds of the cylinder without error.

29 Claims, 36 Drawing Figures

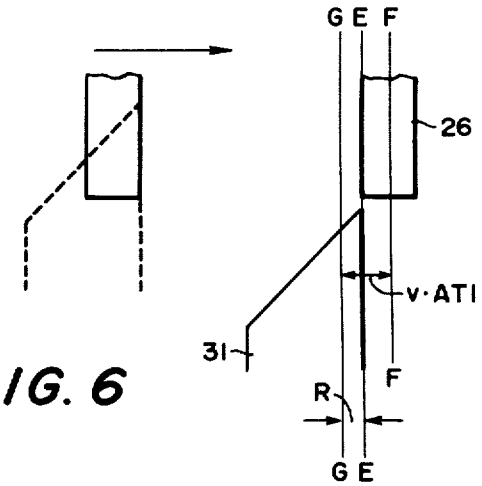
FIG. 6
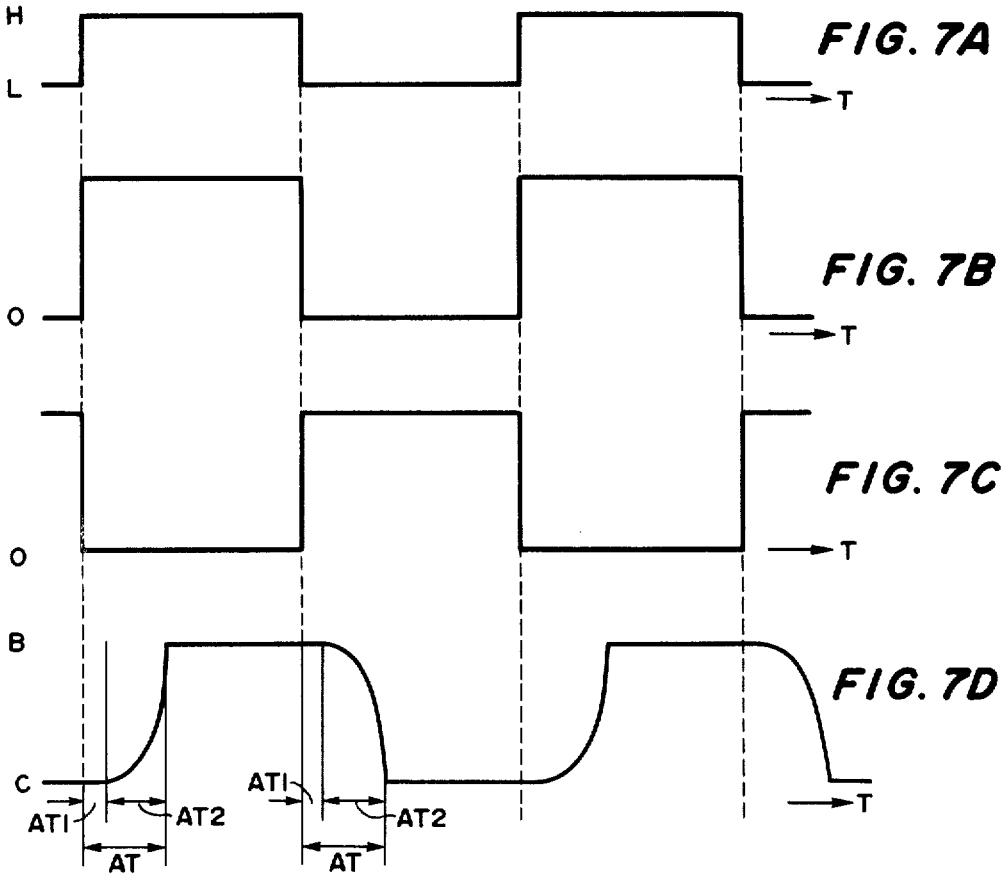
FIG. 7A
FIG. 7B
FIG. 7C
FIG. 7D

NEEDLE SELECTION CONTROL APPARATUS FOR CIRCULAR PATTERN KNITTING MACHINES

BACKGROUND OF THE INVENTION

This invention relates to a needle selection control apparatus for a circular pattern knitting machine, and more particularly to an improved control apparatus which controls the timing of selection of a series of needles mounted on a needle cylinder of an electronic circular pattern knitting machine by supplying to needle selector means of the circular knitting machine input pulse signals produced by sensor means in synchronism with moving cylinder needle and whose phases have angles of lead controlled by the control apparatus in accordance with the increasing number of revolutions of the circular knitting machine.

Electronic circular knitting machines are capable of knitting articles of various patterns at very high speeds, and have hereto been used for industrial mass production purposes. It is known that circular knitting machines of this type have a needle cylinder including a series of knitting needles arranged at regular intervals thereon for axial sliding movement, and needle selector means which selects needles according to desired knitting patterns during high-speed rotation of the needle cylinder and controls the movement of selected needles in axial direction between a knit or operation position for engaging the selected needles with knitting thread and a welt or inoperative position. The known needle selector means includes an electromagnetic actuator which operates to select cylinder needles during the high-speed rotation of the cylinder, and has several different types.

For example, circular knitting machines have a needle cylinder diameter of 760 mm on which a series of about 2,100 needles are mounted and arranged at an extremely small pitch of about 1 mm. A very high performance needle selector means is therefore required so that the selection of needles arranged at such a small pitch and rotating at very high speeds may be carried out within an extremely short period of time and with great accuracy. In a well-known circular pattern knitting machine, cylinder needles are moved at high speeds equivalent to a frequency of several hundred cycles per second. The needle selector means provided in circular knitting machines must meet the need of selecting cylinder needles within a very extremely short time and with great accuracy, and therefore have limitations to the speed at which the machine should be rotated and its knitting capability. The needle selector means also has its performance greatly limited or influenced by the ability of its actuator to respond to input pulse signals within a very short time. As far as circular knitting machines are hereto known, none have such actuators as can satisfy this requirement sufficiently. An actuator is operated upon receipt of input pulse signals to move jacks to a knit position or a welt position for engagement or disengagement with cylinder needles, and in practice an actuator requires a time of a given length for responding to such signals. This time becomes a very important factor which limits the speed of the needle cylinder. Different types of actuators are known, one of which is an actuator which biases jacks to be associated with needles toward the knit position or welt position by mechanically engaging the head of a plunger which is electromagnetically actuated for axial movement, with the jacks. Another known actuator has an electromagnetic solenoid actuated to bias the jacks for movement between the knit and welt positions. Those two actuators have been improved in all aspects, but still have limitations to their response time to which there could be expected no further improvement. It will readily be understood from the above that the circular knitting machine has its speed of rotation limited or influenced by the capability of the needle selector means. The known selector means is not satisfactory in this respect.

The present invention has the above facts in view, is based on the observation that the known circular knitting machine has an actuator whose rise time contains an idle or inactive time, and has overcome the disadvantages above described. With the known circular knitting machine, the actuator has an idle or inactive time of a fixed duration regardless of the number of revolutions of the needle cylinder, which adversely affects the working property or capability of the needle selector means particularly when the needle cylinder is rotating at very high speeds.

The present invention provides an apparatus for controlling the needle selector means for selectively placing cylinder needles in position, and which improves the working property of the needle selector means by eliminating the idle or inactive time earlier mentioned. The elimination of the idle time is carried out by providing input pulse signals of advanced phase for the needle selector means.

SUMMARY OF THE INVENTION

It is therefore one object of the present invention to provide a needle selection control apparatus which is best applied to the needle selector means of electronic circular pattern knitting machines.

It is another object of the present invention to provide a needle selection control apparatus for the needle selector means of electronic circular pattern knitting machines, which supplies input pulse signals whose phases have angles of lead controlled by the apparatus in accordance with the increasing number of revolutions of the needle cylinder.

It is a further object of the present invention to provide a needle selector control apparatus for the needle selector means, said control apparatus including means for supplying exact reference input signals to the control apparatus which are obtained by removing unnecessary contents due to the eccentric needle cylinder from the needle synchronizing signals produced by sensor means in synchronism with each moving cylinder needle.

BRIEF DESCRIPTION OF THE DRAWING

FIG. 6 is a partly enlarged view of the main parts shown in FIG. 5;

FIGS. 7A, 7B, 7C, 7D is an operational diagram of the actuator;

DESCRIPTION OF THE PREFERRED EMBODIMENTS

Figure 1:
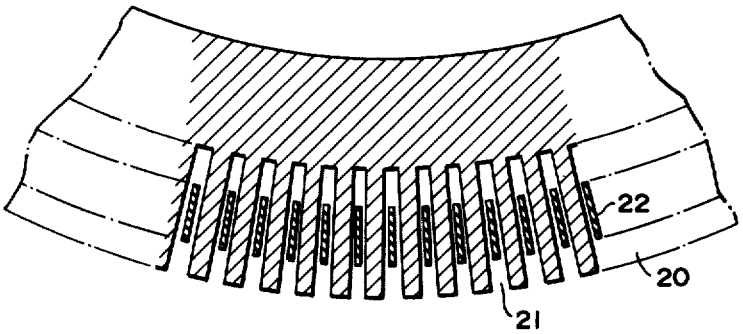
FIG. 1 is a segmentary sectional view of a needle cylinder of a circular knitting machine.

The invention will be further described by way of several preferred embodiments thereof with reference to the accompanying drawings, in which:

Referring first to FIG. 1, there is shown a needle cylinder 20 of a circular knitting machine, which is driven by drive means not shown to turn at high speeds up to about 10 r.p.m. Needle grooves or channels 21 are arranged on the periphery of the needle cylinder 20, each of said channels 21 having one knitting needle 22 mounted therein for sliding movement in axial direction (perpendicular to the plane of the drawing).

Figure 2:
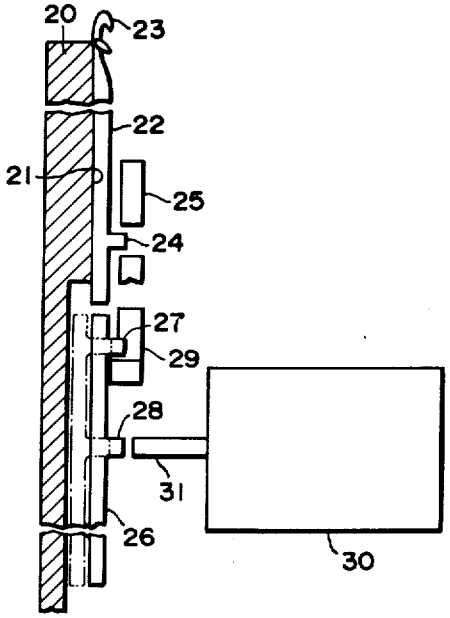
FIG. 2 is a segmentary sectional view showing the main parts of the needle cylinder and an actuator provided in a needle selector means.

As particularly seen in FIG. 2, a needle 22 has a crochat or hook portion 23 at the tip registering with knitting thread, and a butt 24 rigidly mounted in position and cooperating with a cam member 25 located at each feeding station. A jack 26 is mounted in each channel 21 of the needle cylinder 20 for axial and radial sliding movement, and has a first butt 27 and a second butt 28. The first butt 27 registers with a jack cam member 29 rigidly mounted adjacent the cam member 25, and the second butt 28 cooperates with a plunger 31 of an actuator 30 provided in the needle selector means.

Several ten feeding stations and needle selector means are arranged along the periphery of the needle cylinder 20, each of said needle selector means receiving needle synchronizing signals supplied by the needle selection control apparatus including sensor means, and then supplying signals carrying information on desired patterns stored in a program tape of an electronic computer so as to actuate the actuator.

In FIG. 2, a jack 26 is placed in its knit position indicated by the solid line by cam means not shown, and a plunger 31 is shown retracted in the right-hand direction of FIG. 2. In this knit position, the first butt 27 of jack 26 is slightly raised by engaging the jack cam member 29 during the rotation of the needle cylinder 20. A needle 22 is thus moved upward that distance to bring the butt 24 in registry with the cam member 25 so that it is further raised along the cam member 25 to engage its hook 23 with thread. That is the manner in which the knitting operation is carried out.

At the end of the knitting operation, the needle 22 is moved downward along apart (not shown) of the cam member 25 from the knit position back to the position indicated in FIG. 2.

Reversely, as seen in FIG. 2, the jack 26 is placed in a welt position indicated by the broken lines by being urged radially inward by the movement of the plunger 31 forward. Accordingly, the jack 26 has its first butt 27 not engaging the jack cam member 29, so that the needle 22 remain in the lower position. That is the manner in which the welt operation is carried out.

Figure 3:
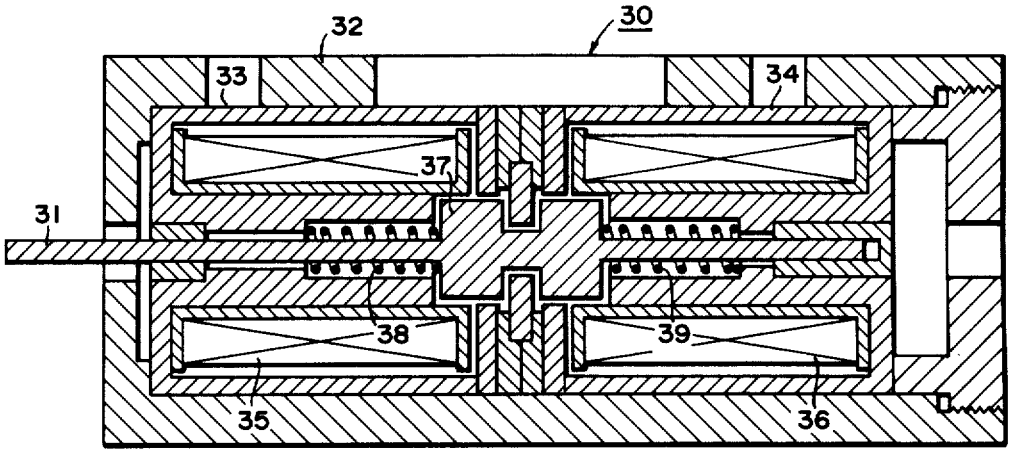
FIG. 3 is a sectional view showing the construction of the actuator.
Figure 4:
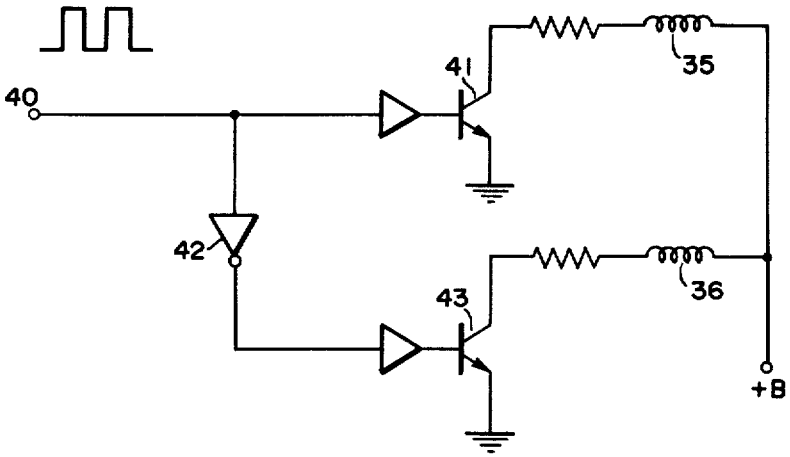
FIG. 4 schematically shows an operational circuit arrangement of the actuator.

Referring next to FIG. 3, there is shown in details the construction of an actuator 30 whose frame 32 has a first yoke 33 and a second yoke 34 coaxially secured opposite each other, the two yokes 33 and 34 including a first winding or coil 35 and a second winding or coil 36, respectively, which are energized and deenergized. The windings 35 and 36 have a plunger 31 supported therein for axial sliding movement, said plunger 31 including a core 37 of ferro-magnetic material which is attracted by the first winding 35 when energized to move the plunger 31 in the left-hand direction, and is attracted by the second winding 36 when energized to move the plunger 31 in the right-hand direction. The core 37 has two springs, a first spring of which shown at 38 urges the core 37 toward the right-hand direction and a second spring shown at 39 urges the core 37 toward the left-hand direction. The windings 35 and 36 are energized when they receive currents from a circuit of drive means provided in the needle selector means. The circuit of drive means is shown in FIG. 4, in which an input terminal 40 receives input pulse signals representing particular knitting patterns in accordance with input signals supplied by the needle selection control apparatus. Pulse signals are first fed to the base of a first switching transistor 41 or through an inverter 42 to the base of a second switching transistor 43, each of the first and second switching transistors having a collector connected with the first winding 35 and a second winding 36 shown in FIG. 3, respectively.

In accordance with the circuit arrangement above described, high-level pulse signals cause only the first switching transistor 41 to conduct and energize the first winding 35 which moves the plunger 31 in the lefthand direction or in the welt position, whereas low-level pulse signals cause only the second switching transistor 43 to conduct and energize the second winding 36 which moves the plunger 31 in the righthand direction or in the knit position.

Referring then to FIG. 5, there are shown a series of jacks 26 controlled by the plunger 31 which operates to selectively place jacks in the knit and welt positions. Each jack 26 rotates in the direction of the arrow A with the rotary movement of the needle cylinder 20. The plunger 31 located opposite a series of jacks 26 has a slanting face at the tip thereof, and moves upward and downward in axial arrow directions B and C. Each jack 26 is placed in a knot position by known cam means not shown before it arrives at a point where the plunger 31 is located, and all jacks 26 have butts whose abutting tips are shown to be biased along or aligned with the line N—N in FIG. 5A.

Figure 5A:
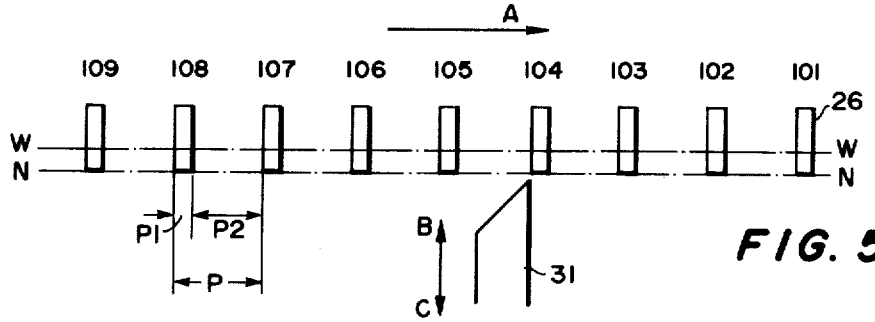
FIGS. 5A, 5B, 5C, 5D schematically shows the relation in movement between jacks and a plunger.
Figure 5B:
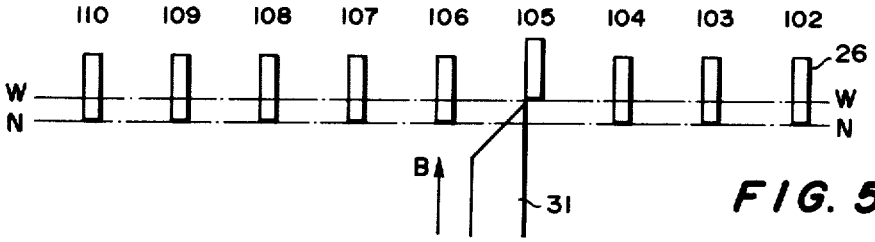
Figure 5C:
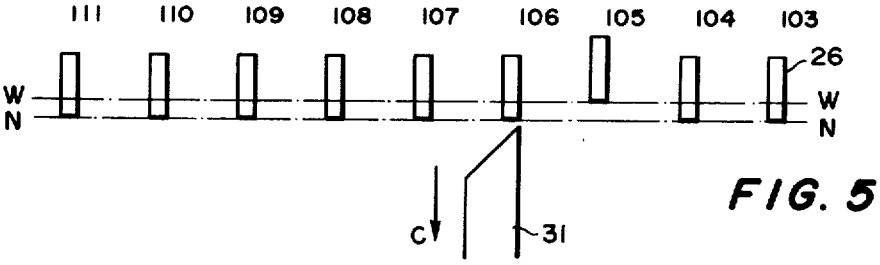

Assume now that it is programmed in accordance with desired knitting patterns that only one jack "105", for example, is placed in a welt position with the others placed in a knit position. In FIG. 5A, a jack "104" is shown just past the plunger 31 which till then has remained to be attracted and urged by the second winding 36 shown in FIGS. 3 and 4 toward the direction C. At the moment that the jack 104 is located just past the plunger 31 in FIG. 5A, a high-level pulse signal is applied to the drive circuit shown in FIG. 4, so that the second winding 36 is deenergized while the first winding 35 is energized. The plunger 31 is then moved toward the direction B, and causes a jack 105 to be raised along the slanting face of the plunger 31 up to the welt position indicated by the line W—W. FIG. 5B shows the moment at which the jack 105 is about to leave the plunger 31. It will be understood that the plunger 31 must completely be moved to the displaced position shown in FIG. 5B before jacks 26 are moved one pitch P. When a low-level pulse signal is applied to the drive circuit with the plunger 31 in the displaced position shown in FIG. 5B, the plunger 31 is then moved in the direction C. The plunger 31 most completely be moved to the retracted position shown in FIG. 5C when a succeeding jack "106" arrives at the point where the plunger 31 is located. It should also be noted that the plunger 31 must completely be retracted before jacks 26 are moved the distance equivalent to a pitch P2 (i.e. pitch P less pitch P1).

Figure 5D:
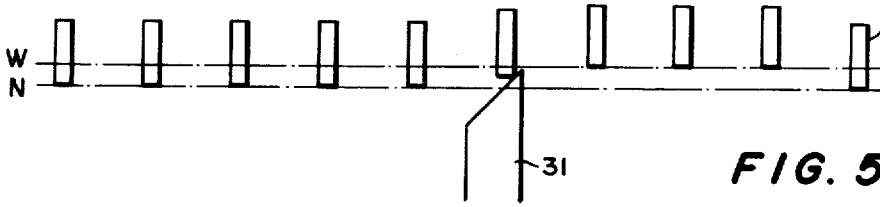

Pulse signals of a different nature are applied to the drive circuit in accordance with the programmed pattern. It is shown in FIG. 5D, for example, that a series of several jacks are placed in the welt position. In this example, the plunger 31 remains in the displaced position shown during that time, so that there arises no problem with the time at which the actuator must respond. FIG. 6 is an enlarged view illustrating a jack 26 and a plunger 31 located opposite each other, in which as shown by the solid line the jack 26 is located just past the plunger 31 or is aligned with the line E—E. It has been described with reference to FIG. 5 that at the passage of the jack 26 past the plunger 31 shown by the solid line in FIG. 6 a pulse signal is applied to the drive circuit to place the plunger 31 in the welt position. Assume then that a pulse signal is applied to the drive circuit earlier or when the plunger 31 is aligned with the line F—F of the jack 26. This assumption does not hold true so far as the known needle selector means is concerned. This is because the needle cylinder rotates at very low speeds when it is starting or stopping, and theoretically it may be considered that the needle cylinder rotates at different speeds that range from zero to high speeds at which it is normally running. In accordance with the known needle selector means, therefore, it means that if a pulse signal is applied to the drive circuit earlier, then it actuates the drive circuit to cause both the jack which should be placed in a welt position and its preceding jack which should be placed in a knit position to be placed in the welt position. Apparently, this is an untolerable improper or error operation of the circuit.

It may also be assumed that a pulse signal is applied later or when the plunger 31 is aligned with the line G—G of the jack 26. In this case, the drive circuit will not improperly be actuated as mentioned above. However, the period of time during which the plunger 31 is allowed to move to the position indicated by the broken lines in FIG. 6 is surely further limited, and this restricts the maximum speed that a circular knitting machine is allowed. In accordance with the known circular knitting machine, despite the above disadvantage, the timing at which the pulse signal is applied is phased at the line G—G. The known machine has so many actuators, and those actuators have their component parts individually machined and assembled, which necessarily result in errors that must be compensated for. Because of this, pulse signals must necessarily be applied at a later timing. This clearly limits the maximum speed at which the circular knitting machine should be run. It is known that an actuator of a good operational property, for example, has a period of time AT of approximately 1.5 m.s. during which it is completely displaced upon receipt of an input pulse signal.

Given a needle cylinder diameter of 762 mm, a total of 1,700 cylinder needles, a jack pitch P of 1.4 mm, a jack width P1 of 0.5 mm and an angle of lag R of 0.2 mm by which the pulse signal lags, it will be understood that the number of revolutions of the needle cylinder can easily be calculated and is limited to less than 11 r.p.m. Referring then to FIG. 7, the response time AT of an actuator will be described in more details. Given time T commonly as abscissa, and supply voltages in FIGS. 7A, 7B and 7C and displacement in FIG. 7D as ordinate, it is seen how the actuator in FIGS. 3 and 4 is operated. It is shown in FIG. 7B that if a high-level pulse signal H shown in FIG. 7A is supplied, it energizes only the first winding 35. It is also shown in FIG. 7C that if a low-level pulse signal L is supplied, it energizes only the second winding 36. Currents that flow through the windings 35 and 36 when those voltages are applied across the windings are obtained from the following equation, respectively, as clear from the known transitional effect:

$$i = \frac{E}{R}\left(1 - e^{-\frac{R}{L}T}\right),$$

where $E$ is supply voltage, $R$ is resistance, $L$ is inductance and $T$ is time. It is acknowledged from the equation that the plunger 31 has a property that its displacement corresponds to a value of current $i$, and takes place after lapse of a time AT upon receipt of supply voltage as best shown in FIG. 7D. Also, this time lag is due to the force of the biasing spring and the frictional force of the plunger 31. It is theoretically and practically proved after further examination of the response time AT that the time AT comprises an initial delay time AT1 and a displacement time AT2, said AT1 occupying significantly great proportions of the time AT. The initial delay time AT1 substantially corresponds to a period of time during which the plunger 31 remains to be at a standstill. It is therefore seen that the plunger 31 and the jack 26 will not interfere with each other even though an input pulse signal is supplied at an earlier timing shown by the position F—F or at an angle of advance equivalent to the distance V·AT1 mm which is a product of the time AT1 and the speed V mm/sec. at which the jack 26 is displaced. This angle should preferably be zero when the needle cylinder rotates at low speeds so as to obviate the improper actuation of the plunger 31, and should be gradually increased as the needle cylinder rotates at increasing speeds. When those needs are satisfied, it is possible to eliminate the idle or inactive time due to the initial delay time AT1 of the actuator, and operate the actuator with great accuracy and within an extremely short time particularly when the needle cylinder rotates at very high speeds.

Figure 8:
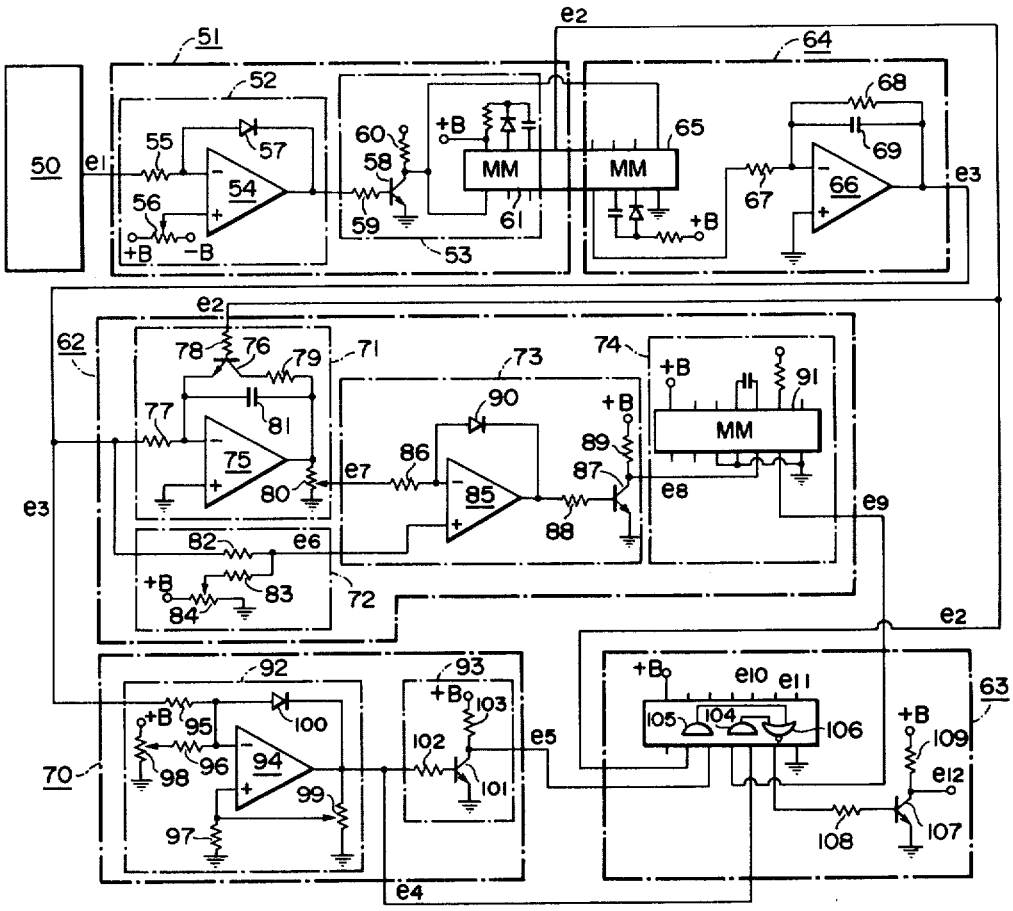
FIG. 8 schematically shows a circuit arrangement of a preferred embodiment of the present invention.
Figure 9:
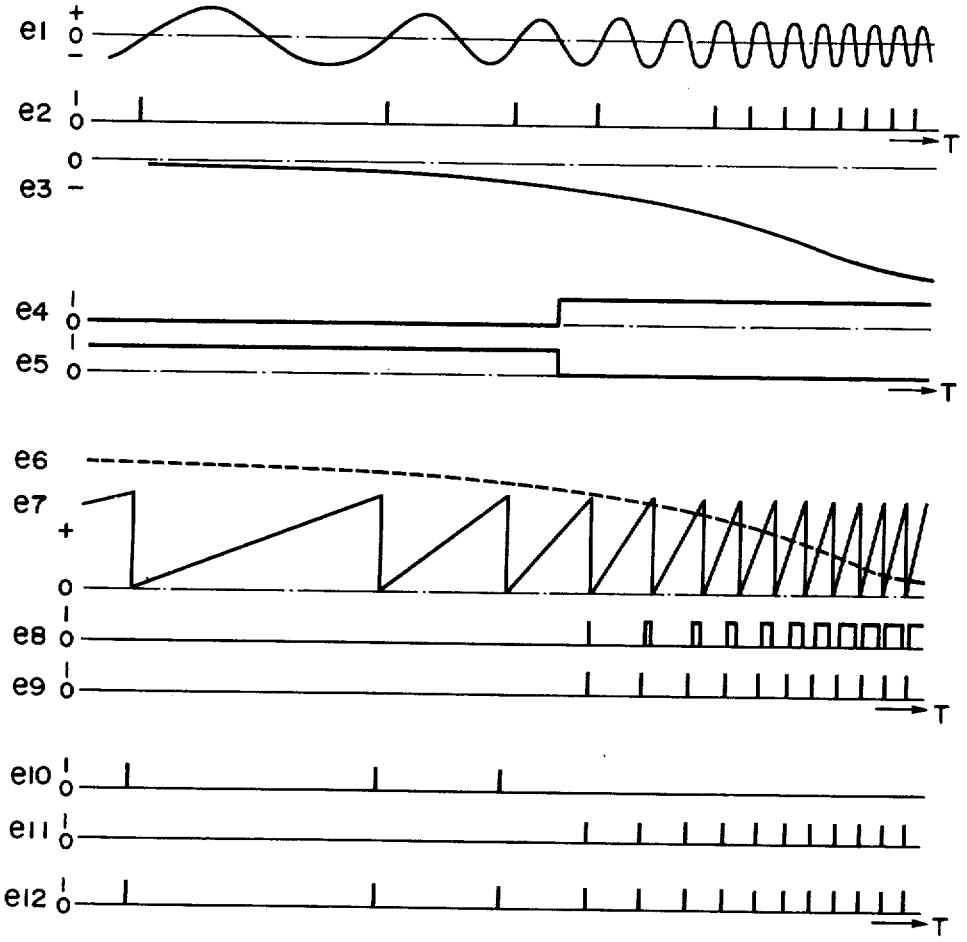
FIG. 9 schematically illustrates waveforms of the circuit elements in FIG. 8.

FIG. 8 schematically illustrates the construction of the needle selection control apparatus according to the present invention which can supply input pulse signals whose phases are advanced, and FIG. 9 shows various waveforms of the signals (time T as abscissa and supply voltage as ordinate are given). Referring then to FIGS. 8 and 9, the control apparatus will be described below. In FIG. 8, a signal generator 50, though not shown in details is provided for producing needle synchronizing signals e1 obtained by optical or electromagnetic sensor means which sense each moving cylinder needle or needle channel. A signal *e*1 has a frequency which corresponds to the number of revolutions of the needle cylinder, and is applied to a pulse shaper 51 which supplies a reference pulse signal *e*2. The pulse shaper 51 consists of a comparator 52 and a pulse generator 53, the comparator 52 including a difference amplifier 54, a resistor 55, a variable resistor 56 and a diode 57, and supplying a rectangular pulse when the signal *e*1 has a value equal to a value previously selected by the variable resistor 56. In the above embodiment, the resistor 56 normally has a value set to a "0" level of the signal e1. A rectangular pulse produced by the comparator 52 is inverted by a circuit of a transistor 58 and resistors 59, 60, and is applied to a monostable multivibrator 61 which converts the inverted pulse to a reference pulse signal *e*2. The reference pulse signal *e*2 is supplied to a phase advancer 62 and a signal selector 63. In the meantime, a pulse signal which corresponds to each needle synchronizing signal is applied to a cylinder speed detector 64 which converts the pulse signal to a dc voltage signal of a frequency proportional to that of the pulse signal. The reference pulse signal *e*2 earlier referred to may be used instead of the pulse signal. In this embodiment, however, a pulse signal of a greater width than the signal *e*2 is obtained by actuating the monostable multivibrator 65 under the control of an output signal of the transistor 58.

A signal thus obtained is applied to a frequency to voltage converter circuit consisting of a difference amplifier 66, resistors 67, 68 and a capacitor 69 and which converts the signal to a dc voltage signal *e*3 carrying information on a different speed of the needle cylinder. The signal *e*3 is then applied to a phase advancer 62 and a cylinder speed discriminator 70. The phase advancer 62 consists of a pulse generator 71 for producing sawtooth waveform signals, an add circuit 72 for accumulating values previously selected by the variable resistor, a comparator 73 and a pulse generator 74, and supplies a pulse signal *e*9 whose phase angle leads the reference pulse signal *e*2 and varies with the increasing number of revolutions of the needle cylinder. The generator 71 includes a difference amplifier 75, a switching transistor 76, resistors 77, 78, 79, a variable resistor 80 and a capacitor 81, and switches on the transistor 76 under the control of the pulse signal *e*2 while actuating the capacitor 81 to store the voltage of the cylinder speed signal *e*3. The capacitor 81 has an integrated voltage which is restored to zero each time a reference pulse signal *e*2 is applied, and whose gain is controlled by the variable resistor 80, so that a sawtoothed waveform *e*7 is produced. The signal *e*2 and cylinder speed signal *e*3 have a corresponding relationship to each other, or more particularly the cylinder speed signal *e*3 has a voltage which increases in proportion to the frequency of the signal *e*2 so that the sawtoothed waveform *e*7 has its waveheight constant despite its varying period of time and intergrating gradient. The cylinder speed signal *e*3 is applied to the add circuit 72 consisting of resistors 82, 83 and a variable resistor 84 which converts the signal *e*3 to a cylinder speed signal *e*6 which has the set value added. The circuit 72 and the earlier-mentioned variable resistor 80 actuate the phase advancer 62 to produce a signal whose angle of advance is controlled. In usual cases, when the cylinder speed discriminator, which will be described in more details later, produces a signal whose angle of advance is controlled as the needle cylinder is reaching a desired number of revolutions, it compares the waveheights of the signal *e*7 and signal *e*6 so that the signal *e*7 may have a voltage equal to or greater than the signal *e*6 which has the set value added. In other words, the voltage levels of the two signals *e*6 and *e*7 are compared by the difference amplifier 85, resistor 66 and diode 90 from which an output is supplied and inverted by transistor 87 and resistors 88, 89 to form a signal *e*8 whose phase is advanced. It is readily understood that the signal *e*8 has a high-level rectangular waveform as long as and only when the sawtoothed waveform signal *e*7 has a voltage which is greater than the cylinder speed signal *e*6, and has a rise time whose angle of lead increases with the increasing speed of the needle cylinder. As the single *e*8 has a fall time which coincides with the reference pulse signal *e*2, it has a width which becomes greater with the increasing speed of the needle cylinder. The singal *e*8 is then applied to a monostable multivibrator 91 of the pulse generator 74, said multivibrator 91 synchronizing with the rise time of the signal *e*8 to produce a pulse signal *e*9 whose phase is advanced. The timing at which the input pulse signal is supplied to the needle selector means should preferably be advanced after the needle cylinder has reached its desired number of revolutions. To this end, the cylinder speed signal *e*3 is supplied to the earlier-mentioned cylinder speed discriminator 70 consisting of a comparator 92 and an inverter 93, said comparator 92 including a difference amplifier 94, resistors 95, 96, 97, variable resistors 98, 99 and a diode 100 and comparing the speed signal *e*3 and the value previously selected by the variable resistor 98 to produce a high-speed region signal *e*4. The resistor 97 and variable resistor 99 are provided for subjecting the difference amplifier 94 to the hysteresis effect which prevents the improper operation due to the ripples included in the speed signal *e*3. The high-speed region signal *e*4 is applied to an inverter 93 including a transistor 101, and resistors 102, 103 by which it is inverted to a low-speed region signal *e*5.

The output signals or gate signals *e*4 and *e*5 of the speed discriminator 70 are applied to AND-gates 104 and 105, respectively, which are provided in the signal selector circuit 63. As the AND-gate 104 receives a pulse signal *e*9 whose phase advanced, it supplies a pulse signal e11 when the needle cylinder is rotating at high speeds. In the meantime, the AND-gate 105 supplies no output signal. As the AND-gate 105 receives a reference pulse signal *e*2, it supplies a reference pulse signal *e*10 when th needle cylinder is rotating at low speeds. In the meantime, the AND-gate 104 supplies no output signal. The output signals of the AND-gates 104 and 105 are applied to a NOR-gate 106 which selectively supplies either the signal *e*10 or signal *e*11, the signal *e*10 or *e*11 being converted to an input pulse signal *e*12 which is supplied through a transistor 107 and resistors 108, 109 to the needle selector means. When input pulse signals *e*12 are applied to the needle selector means, the actuators of the needle selector means are operated with great accuracy and without loss of time because the idle or inactive time due to the initial delay time has been eliminated from the signal *e*12. Therefore, it is possible to increase the speed or number of revolutions at which circular knitting machines should be run.

According to the results of the experiment that has been effected, it is shown that the speed of 11 r.p.m at which a circular knitting machine is usually running can be increased up to 18 r.p.m. without adversely affecting the operational performance of the machine.

Figure 10:
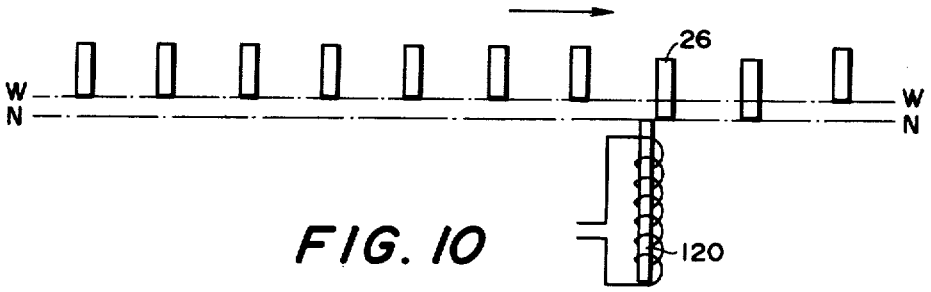
FIG. 10 schematically shows the construction of a solenoid-loaded actuator.

The invention has heretofore been described with reference to an electromagnetic actuator of the needle selector means, but may also apply to a solenoid-loaded actuator. As particularly seen in FIG. 10, a solenoid-loaded actuator includes a solenoid 120 which attracts jacks 26 rotating with the needle cylinder and biases the same between the knit position (line N—N) and welt position (line W—W). The solenoid-loaded actuator has the same operational property as the electromagnetic actuator shown in FIG. 7, and so the manner in which the phase of an input pulse signal is controlled according to the invention can be applied to the solenoid actuator.

The preferred embodiment described with reference to FIG. 8 may be modified in various forms, and the invention should not be limited to the embodiment.

Figure 11:
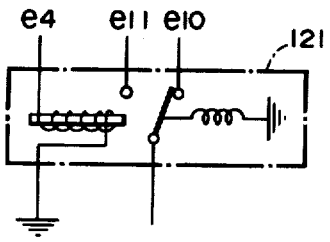
FIG. 11 schematically shows a circuit arrangement of a signal selector circuit embodying the present invention.

FIG. 11 indicates another preferred embodiment of the signal selector circuit which includes no logic circuit, but has an electromagnetic relay 121 controlled by the high-speed region signal *e*4 selectively to supply signals *e*10 and *e*11.

Figure 12:
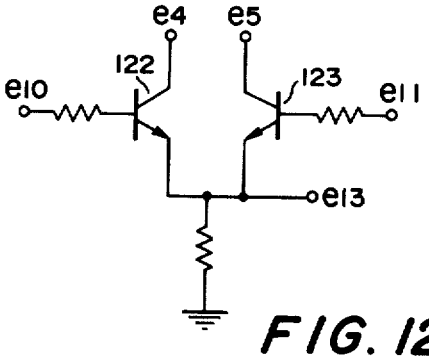
FIG. 12 schematically shows a circuit arrangement of another signal selector circuit embodying the present invention.

FIG. 12 indicates a further preferred embodiment of the signal selector circuit which includes two transistors 122 and 123 whose bases receive the signals e10 and e11, respectively, and whose collectors receive the speed region signals *e*4 and *e*5, respectively. The transistors 122 and 123 have emitters connected with a common line and which supply a desired input pulse signal *e*13.

Figure 13:
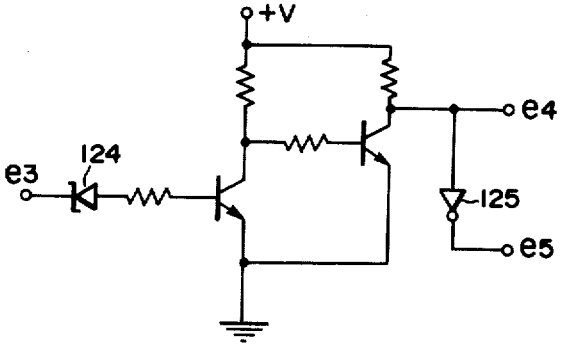
FIG. 13 shows a schematic circuit arrangement of a cylinder speed discriminator according to the present invention.

FIG. 13 indicates another preferred embodiment of the cylinder speed discriminator circuit which includes a zener diode 124 through which speed signals *l*3 are supplied to the amplifier. A value is previously selected by the zener diode 124 and is represented by the zener voltage, which is referred to for discriminating the cylinder speed. The output of the amplifier forms a high-speed region signal *e*4 or is inverted by an inverter 125 to a low-speed region signal *e*5.

It will be understood from the foregoing specification that the particular advantage of the needle selection control apparatus according to the invention is the remarkably increased speed at which the circular knitting machine can be operated.

An input pulse signal *e*12 which is supplied to the needle selector means is derived from a needle synchronizing signal *e*1 supplied by the signal generator 50 which includes sensor means for sensing each moving cylinder needle, as clearly seen in FIG. 8. It will also easily be understood that the needle selection control apparatus will have its better function if it is ensured that needle synchronizing signals *e*1 be produced which are more exactly synchronized with moving cylinder needles.

With the above in view, the present invention provides a needle selection control apparatus which includes a high performance signal generator for producing needle synchronizing signals. It is known that sensor means is provided for sensing moving needles or needle grooves so as to obtain signals which are exactly synchronized with the corresponding needles. Photoelectric sensor means such as photo transistor is known which senses variations in the light which is transmitted by moving objects. The known photoelectric sensor means is, however, very susceptible of dusts from fiber materials when it is used in a circular knitting machine. When it is used in a circular knitting machine which particularly requires lubrication service, it must have an appreciably lower sensing capability. Other known sensor means include electromagnetic sensor means using electromagnetic elements such as high-frequency coil or element of magnetoresistance. The known electromagnetic sensor is intended for sensing variations in the gap or clearance between the sensor and an object. This sensor is not affected by dusts or lubricated oil, and can be used as suitable means of sensing the movement of cylinder needles or cylinder channels and producing signals that are synchronized with the needles. It contributes largely to decreasing the occurrence of irregular needle synchronizing signals which are applied to the needle selection control apparatus.

Recently, the need is increasing for a very high speed circular knitting machine, and is followed by a problem as to a drawback that the electromagnetic sensor has. The drawback is that needle synchronizing signals produced by the electromagnetic sensor means contain errors due to the eccentricity or out-of-roundness (hereinafter referred to as "eccentricity") of the needle cylinder. It is known that the needle cylinder comprises so many assembly parts which are individually machined and assembled. The needle cylinder is inevitably caused to deviate from its center because of the accumulated precision errors of those machined and assembled parts. Thus, the sensor means cannot exactly operate due to errors caused by the eccentricity of the needle cylinder. A signal produced by the sensor means contains a part that represents the deviation of the needle cylinder from its center, the part appearing as an irregular content of the needle synchronizing signal at the needle selection control apparatus. This part has a value of magnitude that cannot be disregarded in a high-speed circular knitting machine.

At noted above, the eccentric content of the signal arises when the needle cylinder deviates from its center, and has a frequency which is clearly lower than the needle synchronizing signal. It may appear that a known high-pass filter may be used to filter the needle synchronizing signal and remove that eccentric content therefrom. However, in view of the various number of revolutions of the needle cylinder which includes a small number of revolutions ranging from a low speed to almost standstill or zero as it is starting or stopping, it will be understood that the use of a high-pass filter is not admittable since the high-pass filter will falsely remove the needle synchronizing signals at such low speeds.

In accordance with the present invention, difference operational means is provided for removing the cylinder eccentric content of the signal which is produced by sensor means and which includes both the eccentric signal and needle synchronizing signal, and means is provided for compensating for any variation that the needle synchronizing signal may have due to the eccentric needle cylinder.

Figure 14:
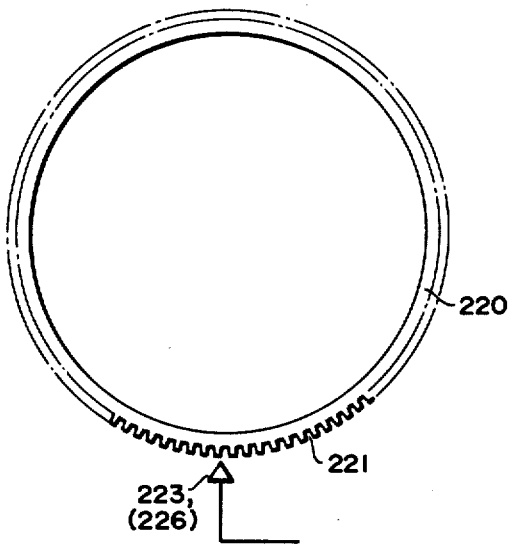
FIG. 14 is a top view showing sensor means located relative to the needle cylinder.
Figure 15:
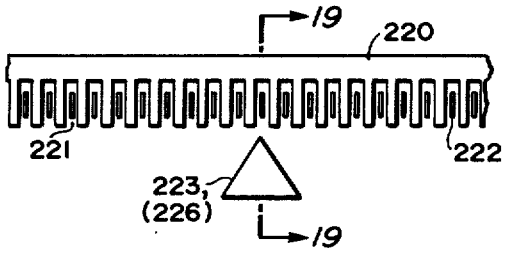
FIG. 15 is a partly enlarged view of FIG. 14.
Figure 16:
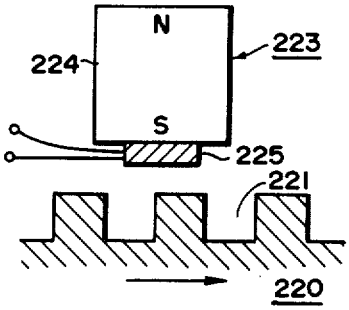
FIG. 16 schematically shows sensor means including an element of magnetoresistance.

Referring then to FIGS. 14 and 15, there is shown a needle cylinder 220 which is driven by drive means not shown to rotate at high speeds, and a series of needle grooves or channels 221 arranged on the periphery of the cylinder 220, each of said needle grooves 221 having one needle 222 mounted for axial sliding movement (perpendicular to the plane of the drawing). A synchronous sensor means 223 is rigidly provided in close proximity of the needle cylinder 220, and should preferably include an element of magnetoresistance or high-frequency coil. FIG. 16 indicates a sensor 223 having an element of magnetoresistance 225 connected to one pole of a permanent magnet 224 and whose resistance varies with the magnetic flux density passing through the element 225. By providing the sensor means 223 in close proximity of the needle cylinder 220, it can respond to concave and convex surfaces of the needle grooves 221 to influence the magnet 224 so that it may have different magnetic flux distribution which changes the resistance of the element 225 accordingly and supply signals that represent values of the resistance thus changed.

Figure 17A:
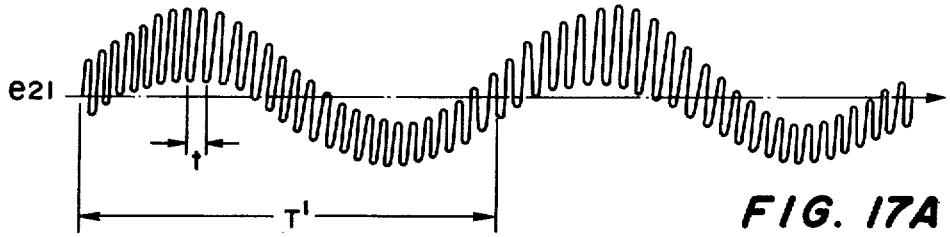
FIGS. 17A, 17B, 17C, 17D schematically shows waveforms of signals for individual circuit elements.

When the circular knitting machine is turned on to rotate its needle cylinder 220, the sensor 223 produces signals *e*21 of a waveform shown in FIG. 17A. In FIG. 17A, time T is given as abscissa and voltage as ordinate. A signal *e*21 produced by the sensor 223 comprises two parts, one representing a needle synchronizing signal of a period $t$ and the other cylinder eccentric signal of a period T'. Given a total number M of cylinder needles, the relationship can be expressed as an equation $t = T'/M$.

Figures 18A, 18B, 18C, 18D, 18E, 18F:
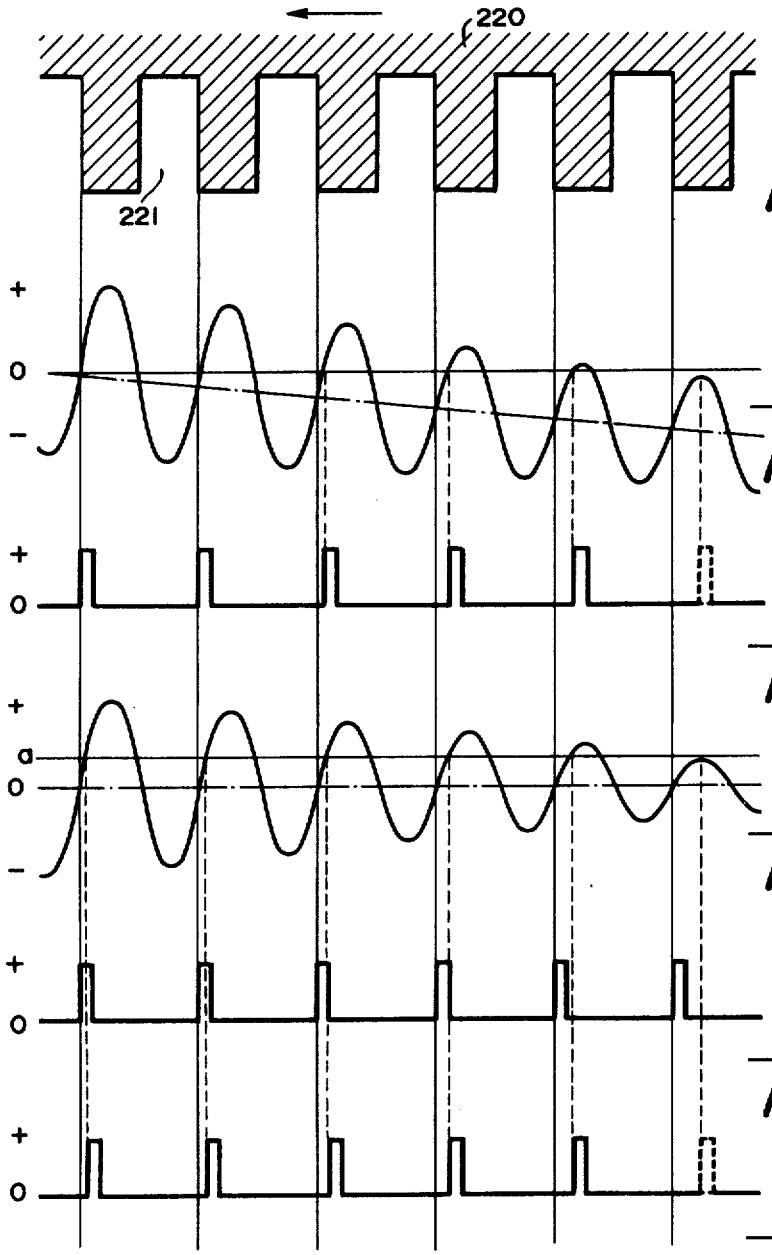
FIGS. 18A, 18B, 18C, 18D, 18E, 18F schematically shows waveforms of signals which are referred to for explaining how error signals occur due to the eccentric needle cylinder.

As seen in FIG. 17A, the signal *e*21 has a slowly undulating waveform formed by a series of cylinder eccentricity signals, and has levels whose center line is unstable. It is also shown that a series of needle synchronizing signals have different amplitudes varying wtih the motion of the undulating wave. In other words, the waveform in FIG. 17A has a ridge formed by a series of needle synchronizing signals of greater amplitudes. This shows that the sensor 223 has its better sensitivity when the gap between the sensor 223 and the needle cylinder 220 is smaller. It has a trough formed by a series of needle synchronizing signals of smaller amplitudes. In this case, the sensor 223 has its lower sensitivity as the gap is greater. As noted above, irregular needle synchronizing signals occur as the signal *e*21 has the slowly undulating waveform formed by signals of irregular amplitudes. Referring then to FIG. 18, there will be described the manner in which such irregular needle synchronizing signals occur. FIG. 18A is an enlarged view of a series of needle channels 221, and FIG. 18B is an enlarged view showing a waveform of the signal *e*21. In a circular knitting machine, a needle synchronizing signal is derived from the signal *e*21, and is supplied to the needle selection control apparatus. In forming a needle synchronizing signal, the signal *e*21 is shaped by a pulse shaper to a pulse signal. It is known that the pulse shaper is actuated by a properly selected reference potential. Assuming in FIG. 18B that the pulse shaper is actuated by a 0 potential to supply a pulse signal, the pulse signal has a phase difference relative to a corresponding needle channel 221 as shown in FIG. 18C, said phase difference being substantially equivalent to the amount of deviation of the undulating waveform from the center line due to the eccentric needle cylinder. This causes needle synchronizing signals not exactly to be synchronized with corresponding cylinder needles.

FIG. 18D indicates a signal which has no undulating waveform but has a ridge and a trough formed by signals of different amplitudes. If the pulse shaper is actuated by a 0 potential, it supplies a pulse signal shown in FIG. 18E which exactly synchronizes with a corresponding needle channel 221. If the pulse shaper is actuated by other potential than the 0 potential, such as an *a* potential shown in FIG. 18D, a pulse signal has a phase difference shown in FIG. 18F, as described with reference to FIGS. 18B and 18C.

Figure 19:
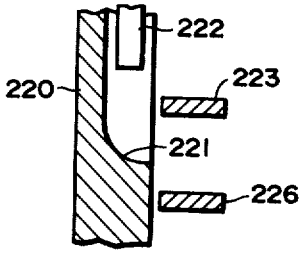
FIG. 19 is a sectional view taken along the line 19—19 in FIG. 15.

In accordance with the present invention, a sensor 226 is provided, in addition to the sensor 223, for sensing the deviation of the needle cylinder from its center. The sensor 226 is constructed the same as the sensor 223, and is located as shown in details in FIG. 19. As particularly shown in FIG. 19, the sensor 226 is located opposite the needle cylinder 220 in the area where needle channels 221 are extended, and in alignment with the sensor 223 along the axial direction of the needle cylinder. The sensor 226 is intended to respond changes in the gap between the sensor 226 and the peripheral surface of the needle cylinder 220, and supplies signals *e*22 shown in FIG. 17B which represent the changes in the gap or the deviation of the needle cylinder 220. It is readily understood that the signal *e*22 has the same phase as that part of the signal *e*22 which represents the deviation or eccentricity of the needle cylinder 220. As noted above, the sensor 226 is located opposite the non-channel or groove area of the needle cylinder 220, but may be placed opposite the channels 221, provided that the sensor 226 is of a sufficiently greater size than a pitch between the two adjacent channels or is placed a little more remote from the peripheral surface of the needle cylinder 220 so that the sensor 226 may produce signals which are not influenced by the presence of the needle channels 221. The sensor 226 thus arranged can supply signals which represent the eccentricity of the needle cylinder 220 and exclude portions representing the presence of the needle channels 221.

Figure 17B:
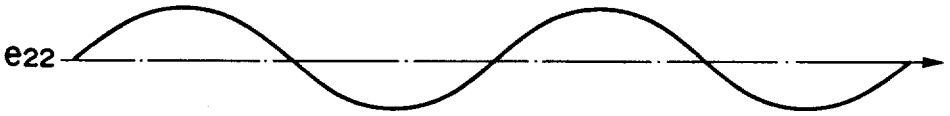
Figure 17C:
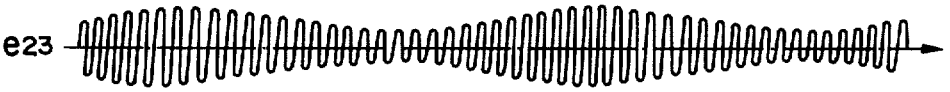
Figure 17D:
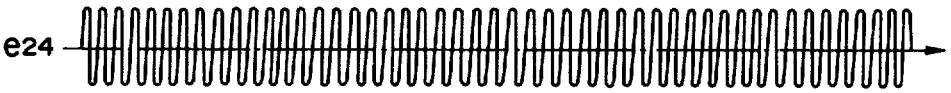
Figure 20:
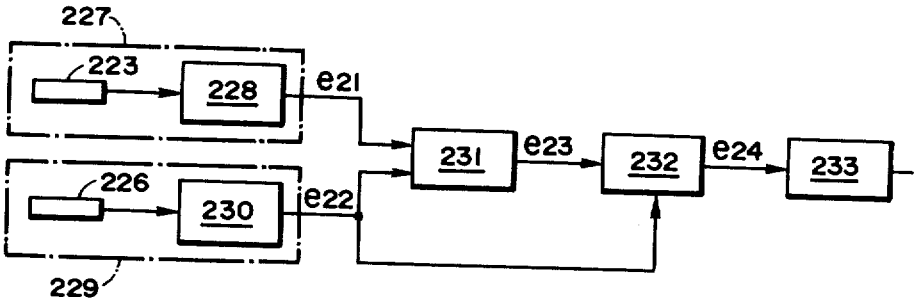
FIG. 20 is a block diagram showing a preferred embodiment of the present invention

FIG. 20 indicates the schematic diagram of the circuit arrangement of a signal generator for producing needle synchronizing signals which are synchronized with the rotary movement of the needle cylinder 220. In FIG. 20, a sensing station 227 including a sensor 223 and an amplifier/converter 228 is provided for supplying signals *e*21. A sensing station 229 including a sensor 226 and an amplifier/converter 230 is provided for supplying signals *e*22 to represent the eccentric needle cylinder. The two signals *e*21 and *e*22 are applied to a difference operational circuit 231 which removes the cylinder eccentric content of the signal *e*21 and supplies a needle synchronizing signal *e*23. As seen in FIG. 17C, the signal *e*23 has no waveform earlier mentioned which is formed by eccentricity signals. However, the signal *e*23 still contains signals of different amplitudes, and is not therefore suited to be applied to the needle selection control apparatus, as earlier described with reference to FIGS. 18D and 18E. Those different amplitudes occur due to the eccentric needle cylinder as mentioned earlier, so that the singal *e*23 is supplied to a gain control circuit 232 shown in FIG. 20 which is actuated under the control of the signal *e*22 for supplying a signal of controlled amplitude. As best seen in FIGS. 17B and 17C, if an eccentricity signal has a greater value, a needle synchronizing signal of greater amplitude is produced; reversely, if an eccentricity signal has a smaller value, a needle synchronizing signal of smaller amplitude is produced. Those amplitudes can be controlled by lowering the gain of the gain control circuit in the former case and by increasing the gain of the same circuit in the latter case. FIG. 17D indicates a needle synchronizing signal *e*24 of controlled amplitude. This signal *e*24 is applied to a pulse shaper 233 shown in FIG. 20 which supplies a pulse signal of a given waveform to the needle selection control apparatus.

Figure 21:
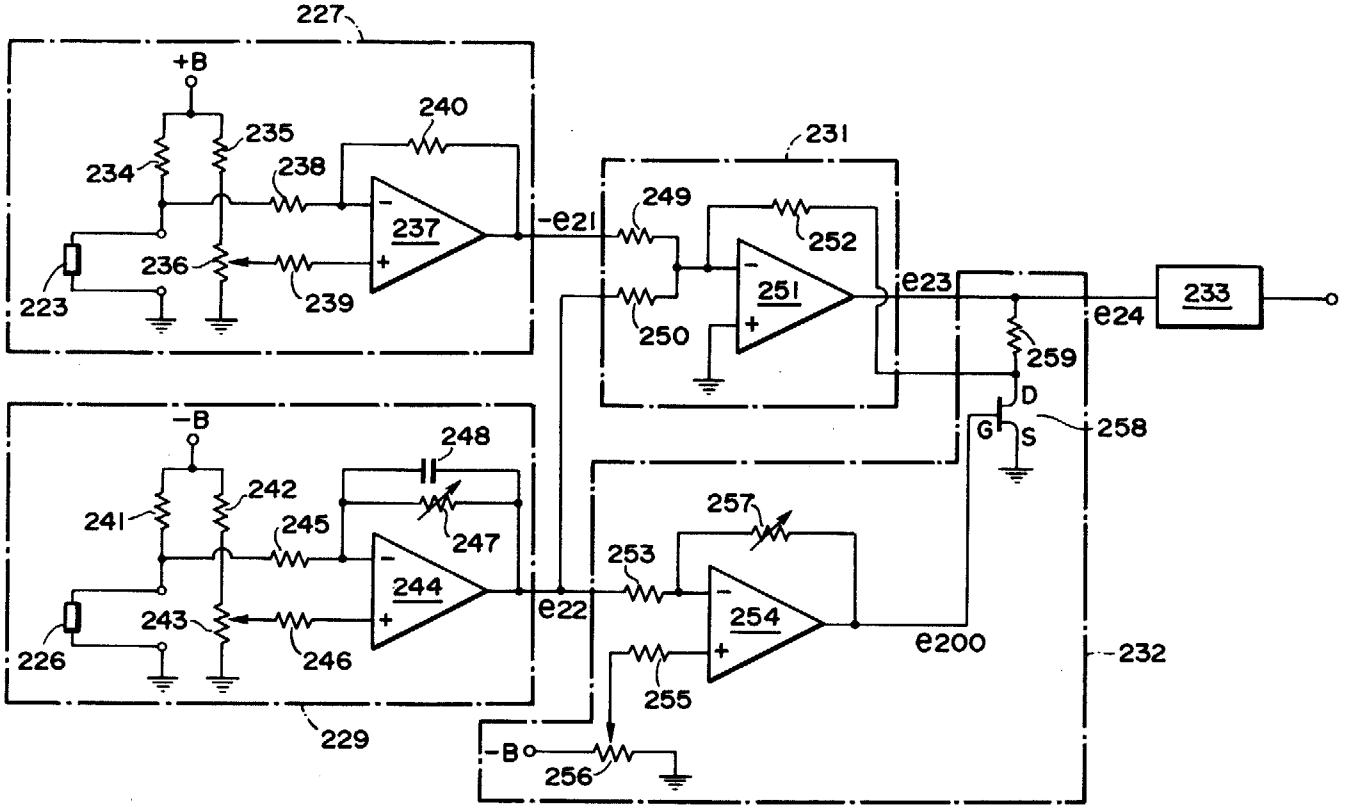
FIG. 21 is a detailed circuit diagram of FIG. 20.

FIG. 21 indicates in details the arrangement of a signal generator for producing needle synchronizing signals according to the present invention. The sensor 223 including an element of magnetoresistance, for example, senses each moving cylinder needle, and supplies signals which are synchronized with corresponding needles and carry different values of the resistance. In the sensing station 227, the sensor 223 is connected with resistors 234 and 235, and a variable resistor 236 to form a bridge by which needle synchronizing signals are converted to voltage signals. The variable resistor 236 is best suited to control the bridge to zero point. Voltage signals are applied to an inverting amplifier consisting of a difference amplifier 237 and resistors 238, 239 and 240 which supplies inverted signals −*e*21. As is the case with the sensing station 227 just described, the sensing station 229 includes a bridge formed by the sensor 226, resistors 241, 242 and a variable resistor 243. Voltage signals supplied by the bridge are applied to an inverting amplifier consisting of a difference amplifier 244, resistors 245, 246, a variable resistor 247 and a capacitor 248 which supplies "cylinder eccentricity" signals +*e*22. The variable resistor 247 is best adapted to control the amplification degree of the inverting amplifier, and the capacitor 248 is best suited to remove high frequency noises.

It is to be noted that a voltage "+B" is applied across the bridge of the sensor station 227, and a voltage "−B" is applied across the bridge of the sensing station 229. As the two bridges receive a voltage of opposed polarity, the sensing station 227 has a signal "−*e*21" of a different polarity from the signal shown in FIG. 17A appearing at the output thereof. This results that the add operation can easily be carried out as described below.

The signals −*e*21 and *e*22 are applied through their respective resistors to an operational circuit 231 consisting of an add inverting amplifier 251 and a resistor 252. As those two signals have an opposed polarity as mentioned earlier, the operational circuit 231 supplies a needle synchronizing signal *e*23 which represents a difference between the two signals, and eliminates the cylinder eccentric contents of the signal produced by sensor means. The signal *e*22 is also applied through a resistor to a difference amplifier 254. The difference amplifier 254 forming an add inverting amplifier together with a resistor 255 and variable resistors 256, 257 controls the gain of the signal *e*22 and inverts the same *e*22, supplying a signal *e*200 whose gain is controlled by adding the previously selected negative voltages −B applied through the variable resistor 256. The signal *e*200 is then applied to the gate of FET 258, and changes the resistance between the drain and source terminals of the FET 258. The drain terminal of the FET 258 is connected through a resistor 259 to a line of the signal *e*23, and is also connected to a feedback resistor 252 of the operational circuit 231, so that the signal *e*200 has a voltage varying between −3V and 0V. As the voltage of the signal *e*200 increases, the gain control circuit has an increased gain that corresponds to the ridge of the signal shown in FIG. 17B, and has a decreased gain that corresponds to the trough of the same signal in FIG. 17B, so that the signal *e*23 has its amplitude controlled. A needle synchronizing signal *e*24 thus obtained in accordance with the invention is then applied to the pulse shaper 233 which supplies a signal of desired waveform which is then applied to the needle selection control apparatus.

Figure 22:
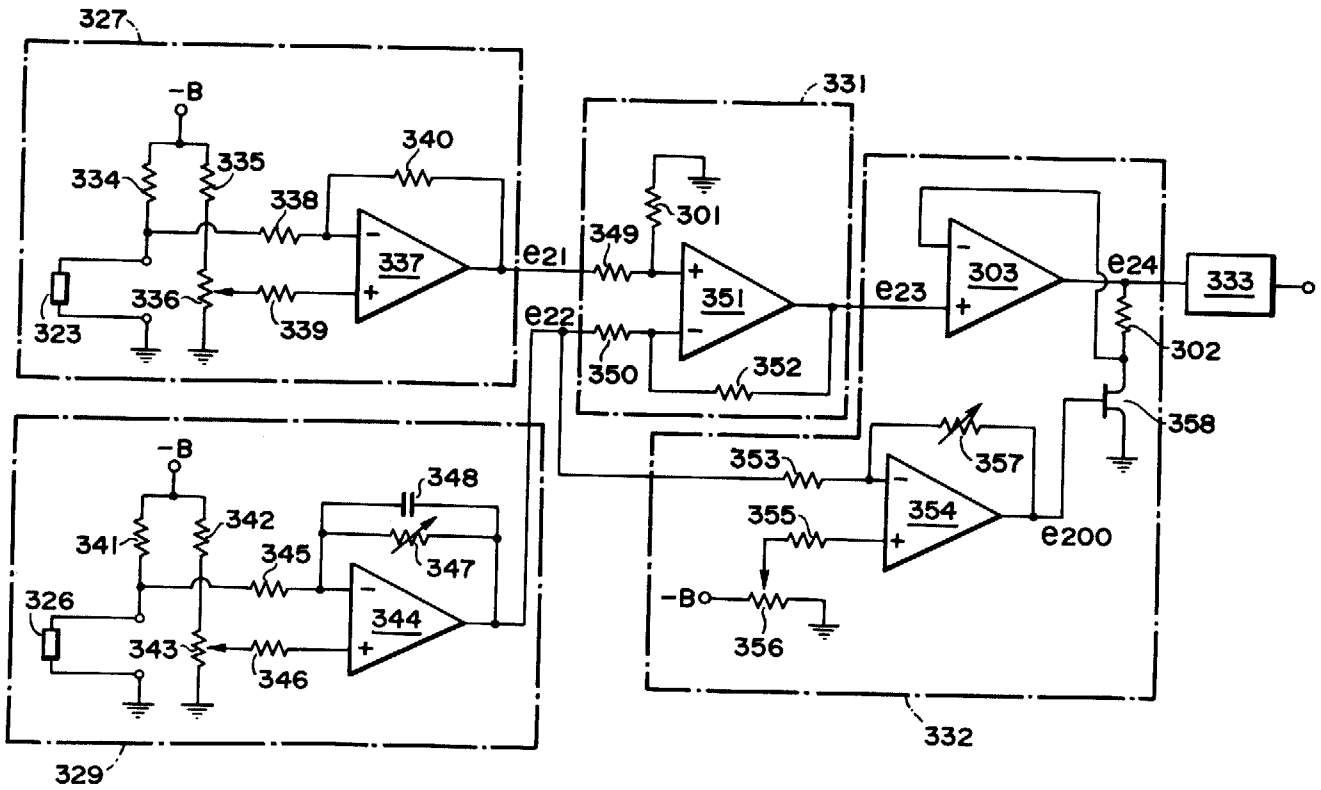
FIG. 22 is a circuit diagram showing another embodiment of the present invention.

FIG. 22 schematically indicates another preferred embodiment of the signal generator for producing needle synchronizing signals. This embodiment is substantially similar to the embodiment earlier described with reference to FIG. 21, except that a needle synchronizing signal and a cylinder eccentricity signal have the same polarity, and are operated so that a difference signal may be obtained. The sensing station 327 for producing needle synchronizing signals and the sensing station 329 for producing cylinder eccentricity signals have the same circuit arrangement as those described with reference to FIG. 21. The difference is that a negative voltage −B is applied across the bridge of the sensing station 327 so that signals *e*21 and *e*22 of positive polarity are produced. The operational circuit 331 constitutes a difference operational circuit consisting of resistors 349, 350, a difference amplifier 351 and other elements shown in FIG. 22. The signal *e*21 is applied through the resistor 349 to an inverting input terminal of the difference amplifier 351 while the signal *e*22 is applied through the resistor 350 to a non-inverting input terminal of the same amplifier 351. The amplifier 351 supplies a needle synchronizing signal *e*23 shown in FIG. 17C which is obtained by removing an eccentric content of *e*22 of the signal *e*21. The inverting input terminal of the amplifier 351 is grounded to the earth through a resistor 301. The signal *e*22 is applied to the gain control circuit 332, and is processed in the same manner as described in the earlier embodiment. Namely, the difference amplifier 354 controls the gain of the signal *e*22 and supplies an inverted signal *e*200 whose gain is thus controlled. The signal *e*200 is then applied to a gate of FET 358, and changes the resistance between the drain and source terminals of the FET 358. The FET 358 has the drain terminal connected in series with a resistor 302 through which the drain terminal is connected to the output of a non-inverting amplifier 303 and the source terminal is grounded to the earth. The FET 358 also has a point of junction between the FET 358 and the resistor 302, said point of junction leading to the non-inverting input terminal of the amplifier 303 for forming a negative feedback path to the amplifier 303. If the resistance between the drain and source terminals of the FET 358 decreases with the increasing voltage of the signal *e*200 of controlled gain (as shown by the trough of the signal in FIG. 17C), the amplifier 303 has a decreased rate of negative feedback and higher gains. Reversely, if the resistance increases with the decreasing voltage of the signal *e*200 of controlled amplitude (as shown by the ridge of the signal in FIG. 18C), the amplifier 303 has an increased rate of negative feedback and lower gains.

As a result, the signal *e*23 applied to the amplifier 303 forms a signal *e*24 of controlled gains (shown in FIG. 17D), which flows to a pulse shaper 333 which forms a reference input pulse signal to be applied to the needle selector means.

As the present invention has heretofore been described in details with reference to the several preferred embodiments, it provides means of producing needle synchronizing signals which are exactly synchronized with the moving cylinder needles and removing irregular portions caused by any eccentric or deviating movement of the needle cylinder from the needle synchronizing signals so that the exact operation of the needle selection control apparatus can be achieved, and this makes it possible to provide a very high-speed circular knitting machine.

It is apparent that various modifications and changes may be made without departing from the scope and spirit of the invention.

We claim:

1. An apparatus for electrically controlling needle selector means of high-speed circular pattern knitting machines so that the needle selector means may be actuated by signals supplied by said apparatus for selectively placing a series of cylinder needles mounted on a needle cylinder for axial sliding movement between a knit or operative position and a welt or inoperative position in accordance with programmed knit patterns, said apparatus comprising a needle synchronizing signal sensing station including a synchronous sensor for producing signals which are synchronized with each cylinder needle rotating with said needle cylinder, a pulse shaper circuit which shapes signals supplied by said synchronous station to reference pulse signals, a needle cylinder speed detecting circuit which converts said reference pulse signals to needle cylinder speed signals which represent the corresponding number of revolutions or speed of the needle cylinder, a phase advancer circuit which produces signals whose phases are advanced by said phase advancer circuit in accordance with the increasing speed of the needle cylinder so that the phases may advance the phases of said reference pulse signals, a needle cylinder speed discriminator circuit which compares said needle cylinder speed signals with a previously selected value for selectively supplying high-speed region signals when the needle cylinder is rotating at speeds above said previously selected value and low-speed signals when the needle cylinder is rotating at speeds below said previously selected value, and a signal selector circuit which selectively supplies said signals of the advanced phase to the needle selector means when the needle cylinder is in its high-speed region and said reference pulse signals to the needle selector means when the needle cylinder is in its low-speed region, whereby said needle selector means can be actuated at very high rotating speeds of the cylinder without error.

2. An apparatus according to claim 1 wherein said pulse shaper circuit includes a comparator circuit and a pulse generator circuit.

3. An apparatus according to claim 2 wherein said comparator circuit includes a differnce amplifier, said different amplifier having one input terminal which receives needle synchronizing signals from said needle synchronizing signal sensing station and the other input terminal which receives signals representing said previously selected value.

4. An apparatus according to claim 2 wherein said pulse generator circuit includes a monostable multivibrator.

5. An apparatus according to claim 1 wherein said needle cylinder speed detecting circuit includes a frequency-to-voltage converter.

6. An apparatus according to claim 5 wherein said frequency-to-voltage converter receives pulse signals which have values corresponding to those of said needle synchronizing signals through said monostable multivibrator.

7. An apparatus according to claim 1 wherein said phase advancer circuit includes a sawtoothed waveform shaper circuit for producing sawtoothed waveforms which have periods and integrating slopes corresponding to those of the needle cylinder speed signals produced by said needle cylinder speed detecting circuit, an add operational circuit which supplies output signals by adding said previously selected value to said needle cylinder speed signals, a comparator circuit which supplies signals of the advanced phase by comparing said sawtoothed waveforms with said output signals of said add operational circuit, and a pulse generator circuit for producing pulse signals synchronized with said signals of said comparator circuit.

8. An apparatus according to claim 7 wherein said sawtoothed waveform shaper circuit includes a capacitor which stores the voltage of each of said needle cylinder speed signals, and switching transistors which are actuated by each of said reference pulse signals so that the voltage stored in said capacitor is restored to zero.

9. An apparatus according to claim 8 wherein said capacitor has a variable resistor connected to said capacitor for the selection of any desired gain.

10. An apparatus according to claim 7 wherein said add operational circuit includes resistors and variable resistors.

11. An apparatus according to claim 7 wherein said comparator circuit includes a difference amplifier, said amplifier supplying rectangular signals which rise earlier in accordance with the increasing speed of the needle cylinder.

12. An apparatus according to claim 7 wherein said pulse generator circuit includes a monostable multivibrator which supplies pulse signals of the advanced phase at the rise time of said rectangular signals.

13. An apparatus according to claim 1 wherein said needle cylinder speed discriminator circuit includes a comparator which supplies signals representing any one of the two or high and low speed regions of the needle cylinder, and an inverter connected to said comparator for supplying signals which represent the other speed region of the needle cylinder.

14. An apparatus according to claim 13 wherein said comparator includes a variable resistor by which values are adjustably selected to represent any desired number of revolutions of the needle cylinder, and a difference amplifier.

15. An apparatus according to claim 13 wherein said comparator includes an amplifier circuit, and zener diodes connected to the input of said amplifier circuit.

16. An apparatus according to claim 1 wherein said signal selector circuit includes an AND-gate element which receives signals representing the high-speed region of the needle cylinder and pulse signals of the advanced phase, an AND-gate element which receives signals representing the low-speed region of the needle cylinder and reference pulse signals, and a NOR-gate element which receives the output signals of the two AND-gate elements.

17. An apparatus according to claim 1 wherein said signal selector circuit includes electromagnetically actuated relay means switchably controlled by any one of said high-speed region signals and said low-speed region signals.

18. An apparatus according to claim 1 wherein said signal selector circuit includes a first transistor having a base which receives pulse signals of the advanced phase and a collector which receives high-speed region signals, and a second transistor having a base which receives reference pulse signals and a collector which receives low-speed region signals, said first and second transistors having a common emitter which supplies input signals for the needle selector means for actuating the actuators of said needle selector means.

19. An apparatus according to claim 1 wherein said synchronous sensor comprises a sensor including an element of magnetoresistance.

20. An apparatus according to claim 19 wherein said sensor has the element of magnetoresistance connected to one pole of a permanent magnet, and is located in close proximity of the needle cylinder.

21. An apparatus according to claim 1 wherein said synchronous sensor comprises a sensor including a high-frequency coil.

22. An apparatus for electrically controlling needle selector means of high-speed circular knitting machines so that the needle selector means may be actuated by signals supplies by said apparatus for selectively placing a series of cylinder needles mounted on a needle cylinder for axial sliding movement between a knit or operative position and a welt or inoperative position in accordance with programmed knit patterns, said apparatus comprising a needle synchronizing signal sensing station including a synchronous sensor for producing signals which are synchronized with each cylinder needle rotating with said needle cylinder, a needle cylinder eccentricity sensing station including a sensor which responds to the eccentricity of the needle cylinder for producing signals which represent the cylinder for producing signals which represent the cylinder eccentricity and is located in alignment with said synchronous sensor along the axial direction of the needle cylinder, a signal generator for producing corrected needle synchronizing signals, said signal generator including a difference operational circuit which supplies difference signals between the needle synchronizing signals and cylinder eccentricity signals and a gain control circuit which controls the gains of said difference signals with said cylinder eccentricity signals, a pulse shaper circuit which shapes said corrected needle synchronizing signals to reference pulse signals, a cylinder speed detecting circuit which converts said reference pulse signals to cylinder speed signals which represent the corresponding number of revolutions of the needle cylinder, a phase advancer circuit which produces signals whose phases are advanced by said phase advancer circuit in accordance with the increasing speed of the needle cylinder so that the phases may advance the phases of said reference pulse signals, a needle cylinder speed discriminator circuit which compares said needle cylinder speed signals with a previously selected value for selectively supplying high-speed region signals when the needle cylinder is rotating at speeds above said previously selected value and low-speed region signals when the needle cylinder is rotating at speeds below said previously selected value, and a signal selector circuit which selectively supplies signals of the advanced phase to the needle selector means when the needle cylinder is in its high-speed region and said reference pulse signals to the needle selector means when the needle cylinder is in its low-speed region, whereby said needle selector means can be actuated at very high rotating speeds of the cylinder without error and without the influence of eccentricity of said needle cylinder.

23. An apparatus according to claim 22 wherein said synchronous sensor and said cylinder eccentricity sensor have their respective element of magnetoresistance connected to one pole of a corresponding permanent magnet, and are located in close proximity of the needle cylinder.

24. An apparatus according to claim 23 wherein each of the elements of magnetoresistance provided in said synchronous sensor and said cylinder eccentricity sensor forms one element of a bridge circuit, said bridge circuits converting the changes of the resistance of said elements to voltage signals, respectively.

25. An apparatus according to claim 24 wherein said bridge circuit receives reference voltages of opposite polarity.

26. An apparatus according to claim 25 wherein said difference operational circuit includes an add operational inverter amplifier which receives two different signals of opposite polarity one of which are produced by said needle synchronizing signal sensing station including said bridge circuit corresponding thereto and the other of which are produced by said needle eccentricity sensing station including said bridge circuit corresponding thereto.

27. An apparatus according to claim 24 wherein said bridge circuit receives reference voltages of identical polarity.

28. An apparatus according to claim 27 wherein said difference operational circuit includes a difference amplifier which receives two different signals of identical polarity one of which are produced by said needle synchronizing signal sensing station including said bridge circuit corresponding thereto and the other of which are produced by said cylinder eccentricity sensing station including said bridge circuit corresponding thereto.

29. An apparatus according to claim 22 wherein said gain correction circuit includes an amplifier circuit which controls the gains of the cylinder eccentricity signals, and a FET element whose resistance between the drain and source terminals varies with the output of said amplifier circuit.

* * * * *